US007466310B2

(12) United States Patent
Yang et al.

(10) Patent No.: US 7,466,310 B2
(45) Date of Patent: Dec. 16, 2008

(54) LINE COMPENSATED OVERDRIVING CIRCUIT OF COLOR SEQUENTIAL DISPLAY AND LINE COMPENSATED OVERDRIVING METHOD THEREOF

(75) Inventors: Yu-Chu Yang, Hsinhua (TW); Ming-Yeong Chen, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 597 days.

(21) Appl. No.: 11/008,985

(22) Filed: Dec. 13, 2004

(65) Prior Publication Data

US 2006/0125748 A1 Jun. 15, 2006

(51) Int. Cl.
*G09G 3/36* (2006.01)
*G09G 5/00* (2006.01)

(52) U.S. Cl. ..... 345/204; 345/87

(58) Field of Classification Search ..... 345/88, 345/87, 204

See application file for complete search history.

(56) References Cited

U.S. PATENT DOCUMENTS 5,457,474 A * 10/1995 Ikeda ..... 345/92
5,642,129 A * 6/1997 Zavracky et al. ..... 345/100
5,734,361 A * 3/1998 Suzuki et al. ..... 345/74.1
6,304,254 B1 * 10/2001 Johnson et al. ..... 345/204
6,603,452 B1 * 8/2003 Serita ..... 345/88
6,791,525 B2 * 9/2004 Matsumura et al. ..... 345/100
2005/0093798 A1 * 5/2005 Kamada et al. ..... 345/89
2005/0093807 A1 * 5/2005 Uchiyama ..... 345/98

FOREIGN PATENT DOCUMENTS

JP 9318929 * 12/1997

* cited by examiner

*Primary Examiner*—Amare Mengistu
*Assistant Examiner*—Robert R Rainey
(74) *Attorney, Agent, or Firm*—Rabin & Berdo, PC

(57) ABSTRACT

A line compensated overdriving circuit for use in a color sequential display is disclosed. The line compensated overdriving circuit comprises an overdrive unit, a line compensation generator, and a line compensated overdrive (LCO) processor. The overdrive unit receives previous data and present data to output overdrive data. The line compensated generator receives a line position of each pixel to output a line compensated factor, and the LCO processor receives the line compensated factor and the overdriven data to generate compensated data for the pixel. Thus, the line compensated overdriving circuit can eliminate the spatial intensity variations associated with the conventional color sequential displays.

5 Claims, 5 Drawing Sheets

LINE COMPENSATED OVERDRIVING CIRCUIT OF COLOR SEQUENTIAL DISPLAY AND LINE COMPENSATED OVERDRIVING METHOD THEREOF

BACKGROUND OF THE INVENTION

1. Field of the Invention

The invention relates in general to overdriving circuits of color sequential displays, and more particularly to line compensated overdriving circuits of color sequential liquid crystal displays (LCDs).

2. Description of the Related Art

In recent years, the flat panel display (FPD) industry has been focused on developing liquid crystal displays (LCDs), especially on developing thin film transistor (TFT) LCDs, and hoping to replace the role of cathode ray tube (CRT) displays in video applications. Each pixel on a TFT LCD is provided with a switching transistor for enabling image data to be written into a panel of the display.

One way of displaying the TFT LCD is to use color sequential technology. A typical frame for displaying a color image is divided into three subframes for the three primary colors of red, green and blue, and each subframe is further divided into a subframe writing period and a subframe illumination period. To display the color image, the TFT LCD is first addressed line by line by display drivers to write image data of the corresponding primary color into the pixels during the subframe writing period, in the meanwhile, capacitors located at each pixel are charged to set the liquid crystals in the pixels to their light transmittive states for displaying appropriate gray values of the corresponding primary color. Then, during the subframe illumination period, light sources, such as light emitting diode (LEDs), are turned on to display the corresponding primary color component of the color image, such that these three primary color components can be compositely perceived as a full-color image. However, the color sequential display is likely to suffer spatial intensity variations, which may cause the bottom portion of the TFT LCD to appear dimmer.

The spatial intensity variations associated with the conventional line addressing method is primarily due to insufficient pixel response times. Conventionally, during the subframe writing periods, the addressing of scan lines usually follows a unidirectional sequence such as from top to bottom or from bottom to top. FIG. 1 illustrates the pixel response time associated with a conventional line addressing method during a subframe writing period of a subframe. Taking a red subframe writing period Tr' for illustration, as shown in FIG. 1, suppose the line addressing sequence is from top to bottom, that is, the top line of the panel is addressed first, and the bottom line of the panel is addressed last. Since the pixels on the top line are first addressed, the pixels on the top line would have sufficient time to respond, that is, have a longest pixel response time of TR1 that is substantially close to the red subframe writing period Tr'. In turn, the pixels on the next line would have a pixel response time of TR2 that is a little shorter that TR1. Yet, the pixels on the following lines would have even shorter pixel response times than TR2. Since the pixels on the bottom line are addressed last and a substantial part of the red subframe writing period has elapsed; the pixels on the bottom line would have a shortest pixel response time of TRn. The response time TRn is significantly less than TR1. Therefore, the pixels on the bottom lines, in case the line addressing sequence is from top to bottom, often do not have sufficient response times to appropriately charge the capacitors that are positioned at each pixel to set liquid crystals in the pixels to their light transmittive states for displaying the appropriate gray value. Consequently, the bottom portion of the panel in the conventional color sequential display often appears dimmer.

Hence, there is a need to provide a novel line compensated overdriving circuit and line compensated overdriving method, such that the spatial intensity variations associated with color sequential display can be greatly eliminated.

SUMMARY OF THE INVENTION

It is therefore an object of the invention to provide a novel line compensated overdriving circuit and line compensated overdriving method for use in a color sequential display such that the spatial intensity variations can be greatly eliminated.

The invention achieves the above-identified object by providing an line compensated overdriving circuit for used in a color sequential display. The line compensated overdriving circuit includes an overdrive unit, a line compensation generator and a line compensated overdrive (LCO) processor. The overdrive unit receives previous data and present data to output overdrive data, wherein the previous data have been used to drive the pixels in a previous subframe. The line compensated generator receives a line position of each pixel to output a line compensated factor, and the LCO processor receives the line compensated factor and the overdrive data to generate a compensated data to drive the pixel.

The invention achieves the above-identified object by further providing a polarity checking unit in the overdrive unit. The polarity checking unit compares the previous data with the present data to output a polarity factor, such that the LCO processor generates the compensated data in response to the overdrive data, the line compensated factor, and the polarity factor.

Also, the invention achieves the above-mentioned object by providing a line compensated overdriving method of a color sequential display. The steps include: first, receiving previous data that have been used to drive the pixels in a previous subframe; then, receiving present data; next, determining an overdrive data in response to the previous data and the present data; then, receiving a line position of each pixel; then, determining a line compensated factor in response to the line position; and outputting, for the pixel, a compensated data in response to the line compensated factor and the overdrive data.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
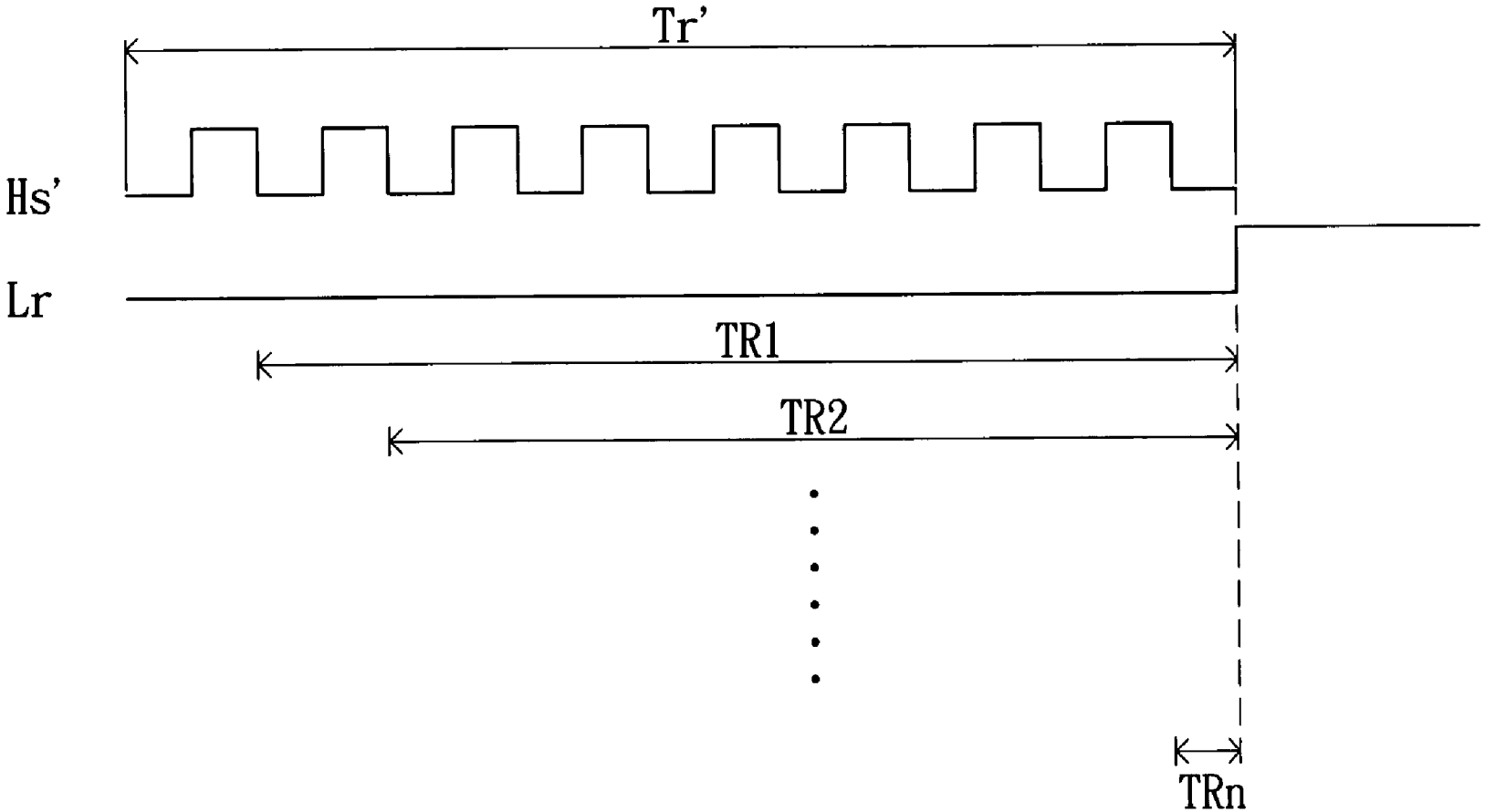
FIG. 1 illustrates the pixel response time associated with a conventional line addressing method during a subframe writing period of a subframe.
Figure 2:
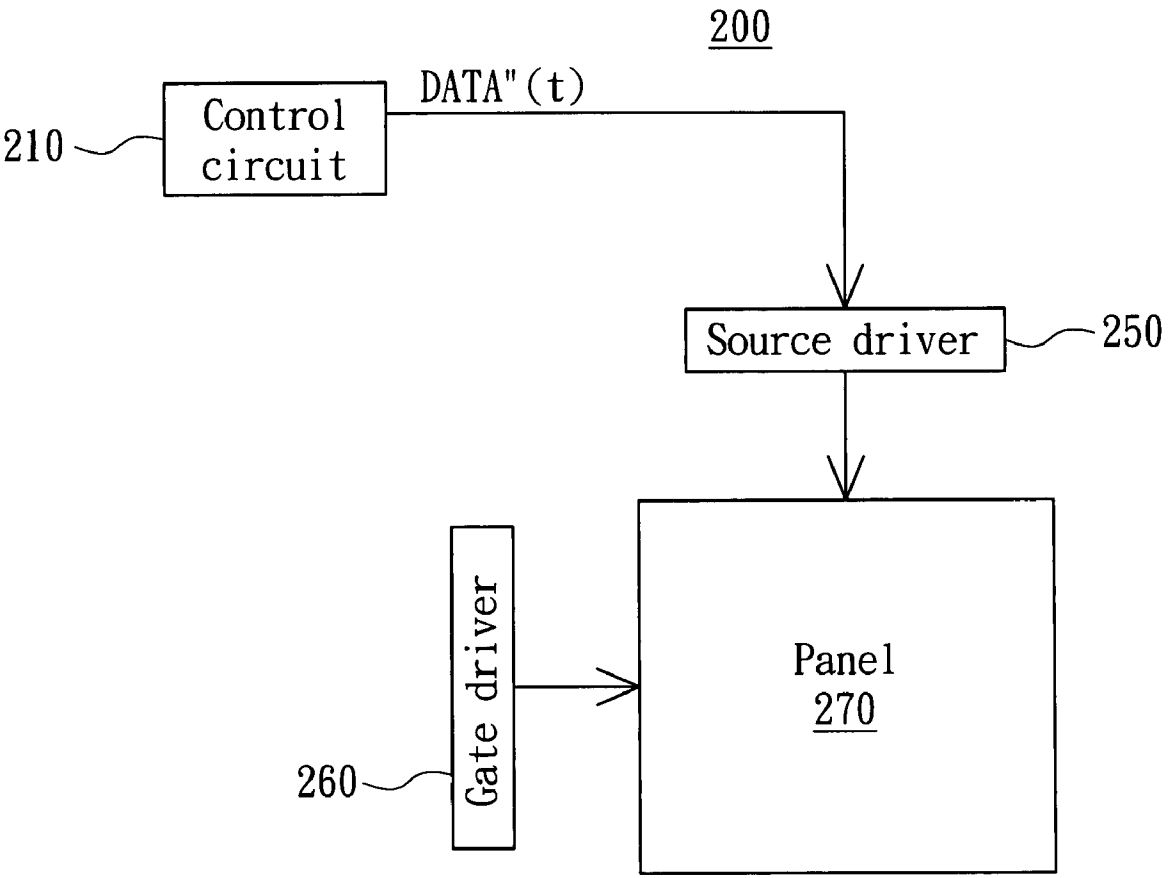
FIG. 2 shows a block diagram of a color sequential display according to a preferred embodiment of the invention.

FIG. 2 shows a block diagram of a color sequential display according to a preferred embodiment of the invention. The color sequential display 300, such as a color sequential liquid crystal display, includes an line compensated overdriving circuit 310, a source driver 250, a gate driver 260, and a panel 270. The line compensated overdriving circuit 310 outputs compensated data DATA"(t) to drive a pixel on panel 270 via the source driver 250. The panel 270 includes pixels that are arranged in a matrix of rows and columns, and receives DATA"(t) from the source driver 250 for writing into the pixels. Preferably, the color sequential display is a color sequential liquid crystal display (LCD), such that the panel of the color sequential LCD has liquid crystals located at each pixel of the panel.

Figure 3A:
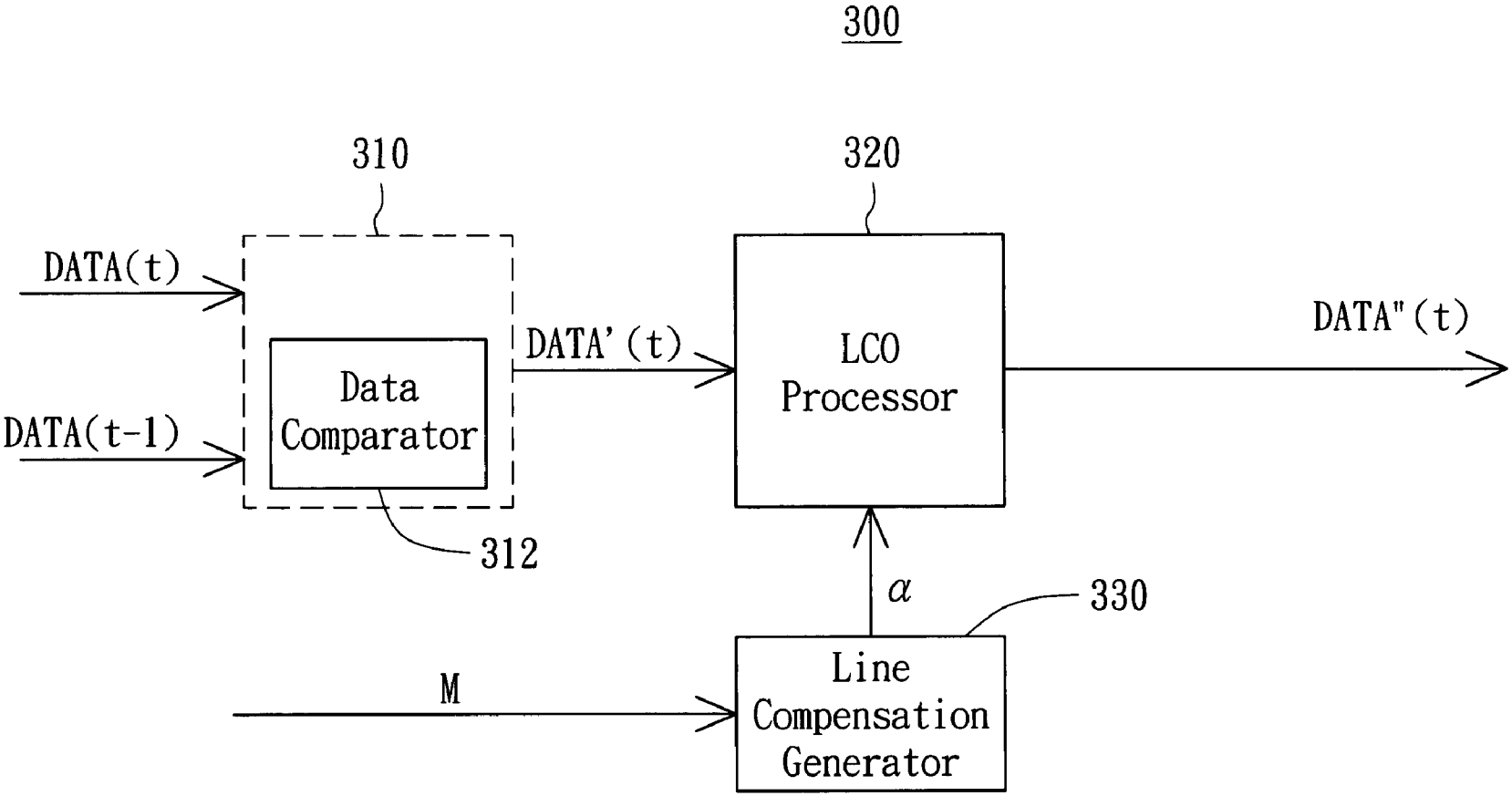
FIG. 3A shows a block diagram of one example of the line compensated overdriving circuit 300.

FIG. 3A shows a block diagram of one example of the line compensated overdriving circuit 300. The line compensated overdriving circuit 300 includes an overdrive unit 310, a line compensated overdrive (LCO) processor 320, and a line compensation generator 330. The overdrive unit 310 includes a data comparator 312 receiving previous data DATA(t−1) and present data DATA(t). The previous data DATA(t−1) refers to data that have been used to drive the pixels during a previous subframe. The preset data DATA(t) refers to data that are about to drive the pixels during a present subframe. The previous data DATA(t−1) is typically being temporarily stored and retrieved from a buffer (not shown). Upon receiving, the data comparator 312 compares present data DATA(t) with the previous data DATA(t−1), and outputs an overdrive data DATA'(t), such as by means of a look-up table, in order to overdrive the pixels depending both on the present data DATA(t) and the previous data DATA(t−1).

Furthermore, the line compensation generator 330 is provided to receive a line position M of each pixel, for example, the line position M is obtained based on the horizontal synchronization signal. From the line position M of the pixel, the line compensation generator 330 outputs a line compensated factor α. The line compensated factor α, for instance, is derived according to a table look-up method, such that the compensated factor α for the pixels on the bottommost line is greatest in order to shorten pixel response time and the compensated factor α for the pixels on the topmost line is smallest. By this, the spatial intensity variations associated with the conventional line addressing method, for example, in case the line addressing sequence is from top to bottom, can be effectively compensated. The LCO processor 320 receives the line compensated factor α from the line compensation generator 330, and the overdrive data DATA'(t) from the overdrive unit 310, and generates a compensated data DATA"(t) to drive the pixel of the present data DATA(t). More specifically, the compensated data DATA"(t) is generated by multiplying the line compensated factor α and the original overdrive data DATA'(t), as shown in the following equation:

$$\mathrm{DATA''}(t)=\mathrm{DATA'}(t)*\alpha \tag{1}$$

Consequently, based on equation (1), the compensated data DATA"(t) is generated by LCO processor 320 and written into the pixel, thereby driving the pixel of the present data DATA (t).

Figure 3B:
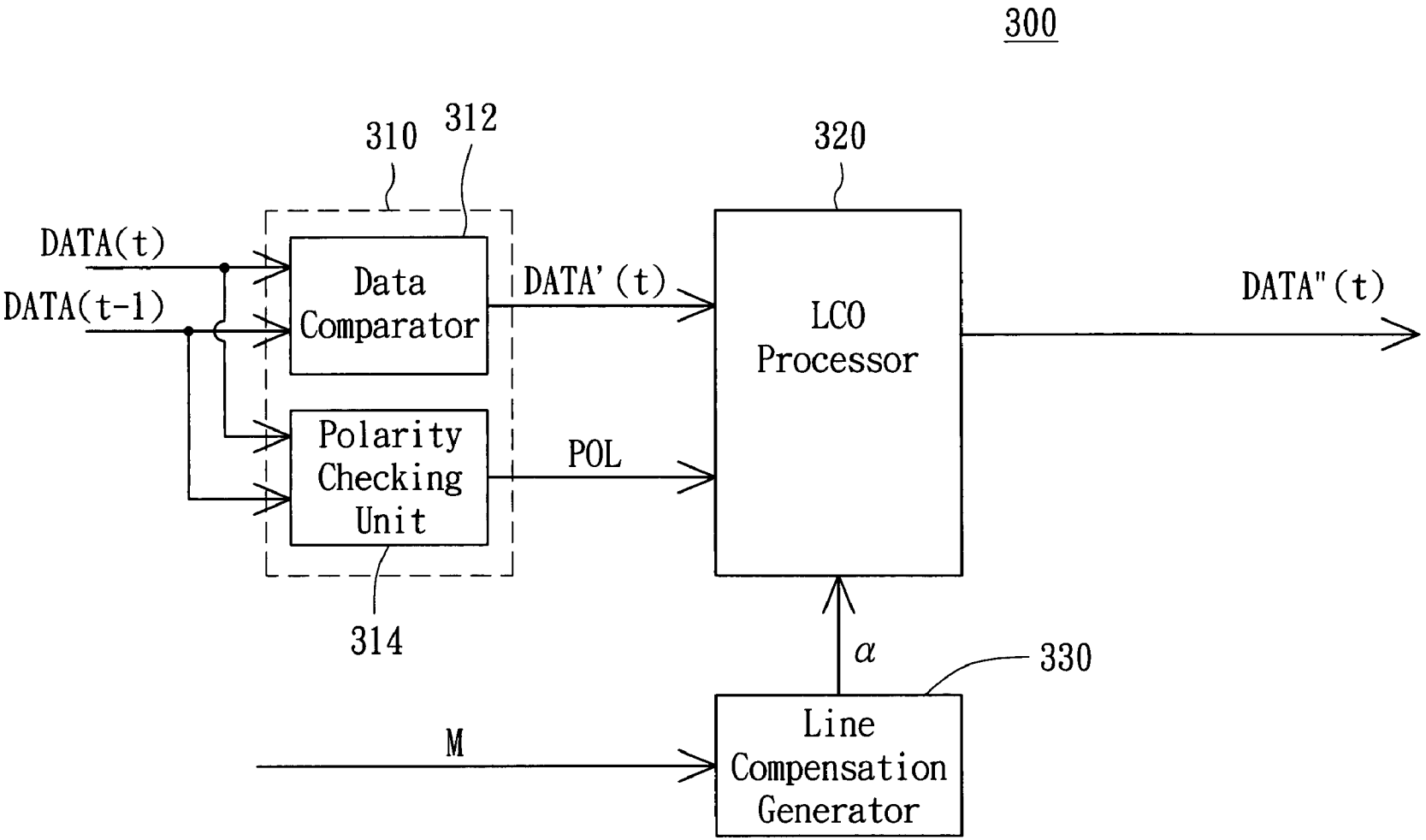
FIG. 3B shows a block diagram of another example of the line compensated overdriving circuit 300.

FIG. 3B shows a block diagram of another example of the line compensated overdriving circuit 300. In addition to the data comparator 312, the overdrive unit 310 further includes a polarity checking unit 314 that compares the previous data DATA(t−1) with the present data DATA(t) to output a polarity factor Pol. Referring to FIG. 3B, the LCO processor 320 further receives the polarity factor in addition to the overdrive data Data'(t) and the line compensated factor α, and generates the compensated data Data"(t) in response to the overdrive data Data'(t), the line compensated factor α and the polarity factor POL. More specifically, the compensated data DATA"(t) is generated by summing the overdriven data DATA'(t) and a product of the polarity factor POL and the line compensated factor α, as shown in the following equation:

$$\mathrm{DATA''}(t)=\mathrm{DATA'}(t)+POL*\alpha \tag{2}$$

Also, in equation (2), the polarity of the polarity factor POL is dependent of the preset data DATA(t) and the previous data DATA(t−1). Namely, the polarity factor POL is negative if the present data DATA(t) is smaller than the previous data DATA (t−1). Otherwise, the polarity factor POL is positive.

Consequently, based on equation (2), the compensated data DATA"(t) is generated by the LCO processor 320 and written into the pixel, thereby driving the pixels corresponding to the present data DATA(t).

With the line compensated overdriving circuit 300 as illustrated, the pixel response time required for the pixels on the bottom lines of the panel, in case the line addressing sequence is from top to bottom, can be effectively reduced due to the compensated data DATA"(t) generated by the LCO processor 320. In this case, the pixels on the bottom lines can have sufficient time to properly charge the capacitors at each pixel to their light transmittive states, and thus display the appropriate gray value. Hence, the spatial intensity variations associated with the conventional color sequential display can be effectively reduced, and users are able to perceive color images on the panel as having evenly distributed brightness.

Figure 4:
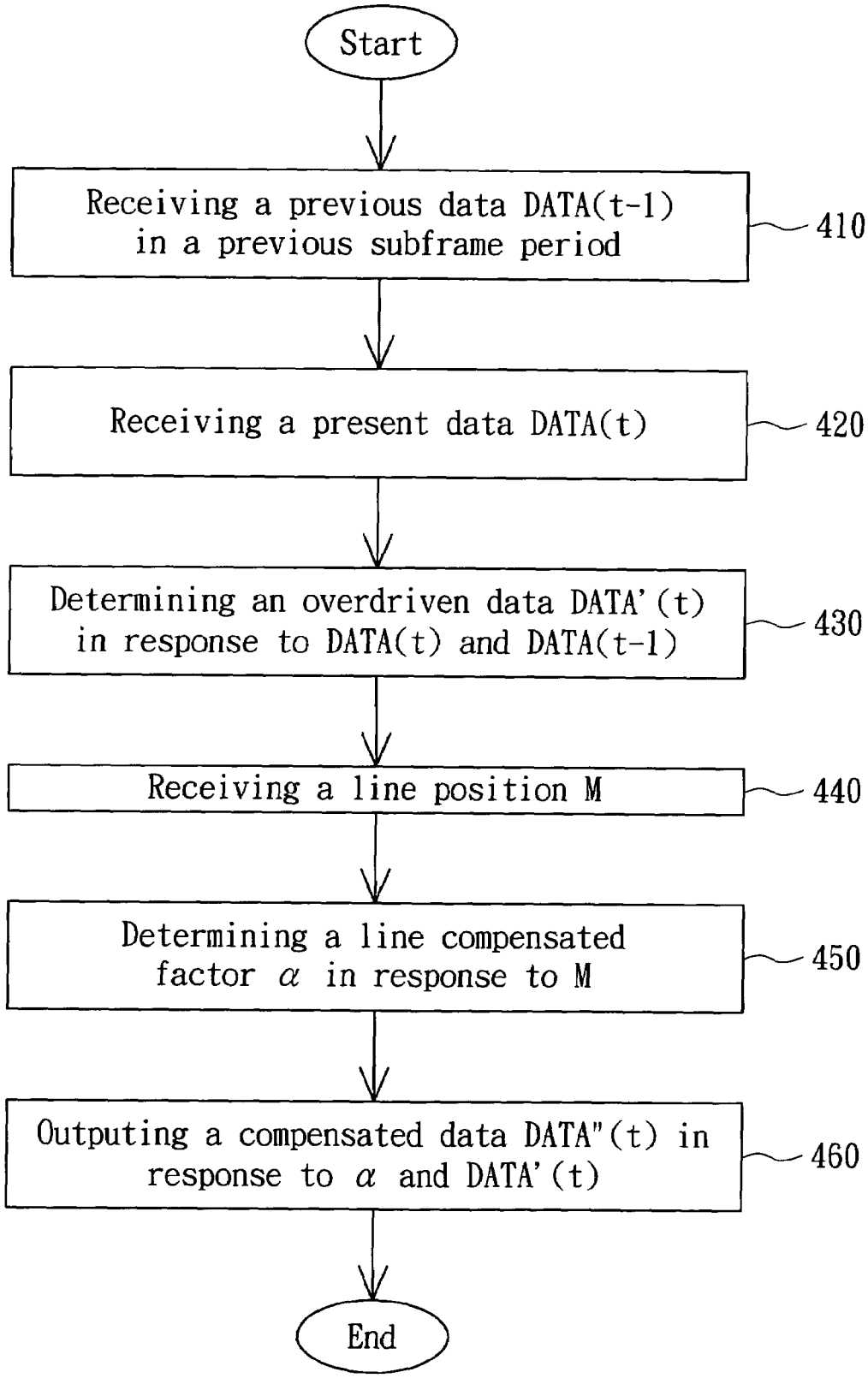
FIG. 4 shows a flow chart of one example of the line compensated overdriving method.

The invention also provides a line compensated overdriving method for a color sequential display, as shown in FIG. 4, in order to reduce the spatial intensity variations associated with the conventional line addressing method. First, step 410 is performed to receive previous data DATA(t−1) that have been used to drive the pixels during a previous subframe. Then, in step 420, present data DATA(t) are received, which are about to drive the pixels in the coming subframe. Next, step 430 is performed to determine an overdrive data DATA' (t) in response to the previous data DATA(t−1) and the present data DATA(t). In step 440, a line position M of each pixel is received. In step 450, a line compensated factor α in response to the line position M is determined. Then, step 460 is performed to output a compensated data DATA"(t) in response to the line compensated factor α and the overdrive data DATA' (t), in order to drive the pixels of the present data DATA(t) in the coming subframe.

In one example of the invention, step 460 further comprises the steps of comparing the present data DATA(t) and the previous data DATA(t−1) to output a polarity factor POL; and generating the compensated data DATA"(t) in response to the polarity factor POL, the line compensated factor α and the overdrive data DATA'(t).

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A line compensated overdriving circuit, adapted for a color sequential display, the line compensated overdriving circuit comprising:

an overdrive unit receiving previous data and present data to output overdrive data, wherein the previous data have been used to drive pixels of the color sequential display in a previous subframe and the overdrive unit further comprises a polarity checking unit that compares the previous data with the present data to output a polarity factor;

a line compensation generator receiving a line position of each pixel to output a line compensated factor; and a line compensated overdrive (LCO) processor receiving the line compensated factor, the polarity factor and the overdrive data and compensating the overdrive data according to the line compensated factor and the polarity factor to generate compensated data to drive the pixel.

2. The line compensated overdriving circuit according to claim 1, wherein the color sequential display is a color sequential liquid crystal display.

3. The line compensated overdriving circuit according to claim 1, wherein the polarity factor is negative if the present data is smaller than the previous data, otherwise the polarity factor is positive.

4. The line compensated overdriving circuit according to claim 3, wherein the LCO processor sums the overdriven data and a product of the polarity factor and the line compensated factor to generate the compensated data.

5. A driving method of a color sequential display, comprising:

receiving previous data that have been used to drive the pixels in a previous subframe;

receiving present data;

determining an overdrive data in response to the previous data and the present data;

receiving a line position of each pixel;

determining a line compensated factor in response to the line position;

comparing the present data and the previous data to output a polarity factor; and generating compensated data for the pixel in response to the polarity factor, the line compensated factor and the overdrive data.

* * * * *